US011772834B2

(12) United States Patent
Roe et al.

(10) Patent No.: US 11,772,834 B2
(45) Date of Patent: Oct. 3, 2023

(54) METHOD FOR SYNCHRONIZING A CONTAINER CARRIER APPLICATING MACHINE

(71) Applicant: ILLINOIS TOOL WORKS INC., Glenview, IL (US)

(72) Inventors: William T. Roe, Aledo, IL (US); Brian K. Williams, Simpsonville, SC (US); Christopher J. Samaras, Tinley Park, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/718,948

(22) Filed: Apr. 12, 2022

(65) Prior Publication Data

US 2022/0324598 A1 Oct. 13, 2022

Related U.S. Application Data

(60) Provisional application No. 63/174,288, filed on Apr. 13, 2021.

(51) Int. Cl.

| | |
|---|---|
| ***B65B 57/02*** | (2006.01) |
| ***B65B 17/02*** | (2006.01) |
| ***B65B 43/42*** | (2006.01) |

(52) U.S. Cl.

CPC ..... *B65B 17/025* (2013.01); *B65B 43/42* (2013.01); *B65B 57/02* (2013.01)

(58) Field of Classification Search

USPC ..... 53/48.4

See application file for complete search history.

(56) References Cited

U.S. PATENT DOCUMENTS

2012/0311962 A1* 12/2012 Hahn ..... B67B 3/26 53/281
2020/0283179 A1* 9/2020 Johansen ..... B65B 35/58

FOREIGN PATENT DOCUMENTS

CN 106275635 B 11/2017
CN 111301735 A * 6/2020

OTHER PUBLICATIONS

ISA/US, English language verison of the International Search Report, Form PCT/ISA/210, for International Application PCT/US2022/024588, dated Apr. 13, 2022 (05 pages).
ISA/US, Form PCT/ISA/237, Written Opinion of the International Searching Authority, for International Application PCT/US2022/024588, dated Apr. 13, 2022 (07 pages).

* cited by examiner

*Primary Examiner* — Chinyere J Rushing-Tucker
(74) *Attorney, Agent, or Firm* — Pauley Erickson & Swanson

(57) ABSTRACT

A system and method of identifying and maintaining synchronization of components within a container carrier applicating machine includes connecting a plurality of point of use feedback devices to operative components of the applicating machine and providing visual feedback from the plurality of feedback devices of location of sychronized and or unsynchronized components.

11 Claims, 2 Drawing Sheets

DETAIL A

DETAIL B

DETAIL A

METHOD FOR SYNCHRONIZING A CONTAINER CARRIER APPLICATING MACHINE

CROSS REFERENCE TO RELATED APPLICATION

This application claims the benefit of U.S. Provisional Application, Ser. No. 63/174,288, filed 13 Apr. 2021. This U.S. Provisional Application is hereby incorporated by reference herein in its entirety and are made a part hereof, including but not limited to those portions which specifically appear hereinafter.

BACKGROUND OF THE INVENTION

Field of the Invention

This invention relates to the operation of a container carrier applicating machine.

Description of Prior Art

Container carriers connect two or more containers into a sturdy unitized package or "multipack" of containers. Carriers are generally planar arrays of rings, sometimes referred to as "six-pack carriers," typically formed from a thermoplastic sheet material. Carriers are applied to containers of various sizes and shapes.

Conventional container carrier applicating machines apply generally continuous strips of container carriers onto containers such as cans or bottles. However, difficulties arise when stopping and restarting an applicating machine, particularly in maintaining the desired timing and alignment between carrier and container. Different components of the applicating machines include an infeed conveyor and an infeed screw that provide containers to the machine, a jaw drum that applies container carrier to containers, and one or more star wheels which present containers to the jaw drum. The infeed conveyor, infeed screw, jaw drum and/or the star wheels may each operate in a same or separate axis of rotation (horizontal, vertical and/or diagonal). Additional components including cutoff devices, turner-diverters, reel stands and orienters may also be in line in the machine and include aligned, perpendicular and or diagonal axes of rotation.

In a standard system containing synchronized servo motion each of the axes of rotation need to maintain a specific following relationship to ensure proper machine function. As such, a typical operating program will include methodology to maintain and recover this synchronization based on several motor positions or velocity parameters. If one of these monitored parameters exceeds the tolerance band, the axes will require resynchronization. Typically, this can be performed as an automatic process once the system is cleared of product. Clearing product requires shutting down the production line. The process of clearing the system, enabling the synchronization routine, and re-priming the product can accumulate significant downtime and lead to lost production. Manual resynchronization methods can reduce this downtime, but this is largely a guess and test method of resolution.

Therefore, a need exists for a system and method for synchronizing a container carrier applicating machine.

SUMMARY OF THE INVENTION

According to one preferred embodiment of this invention, a system for packaging containers preferably includes an inlet conveyor, an infeed screw, a jaw drum, a starwheel, an orienter, a cutoff device and/or a turner-diverter. The system accepts a plurality of containers from the inlet conveyor and singularizes each container and/or rotates each container into a desired rotational position for presentation to a jaw drum for unitization with a generally continuous stream of container carriers. Packaged containers are then divided into separate packages and moved downstream for further packaging, distribution and/or palletization.

Point of use feedback devices are introduced to the operative components of the applicating machine to signal synchronization among the components and reduce recovery time thereby maximizing machine uptime and productivity.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
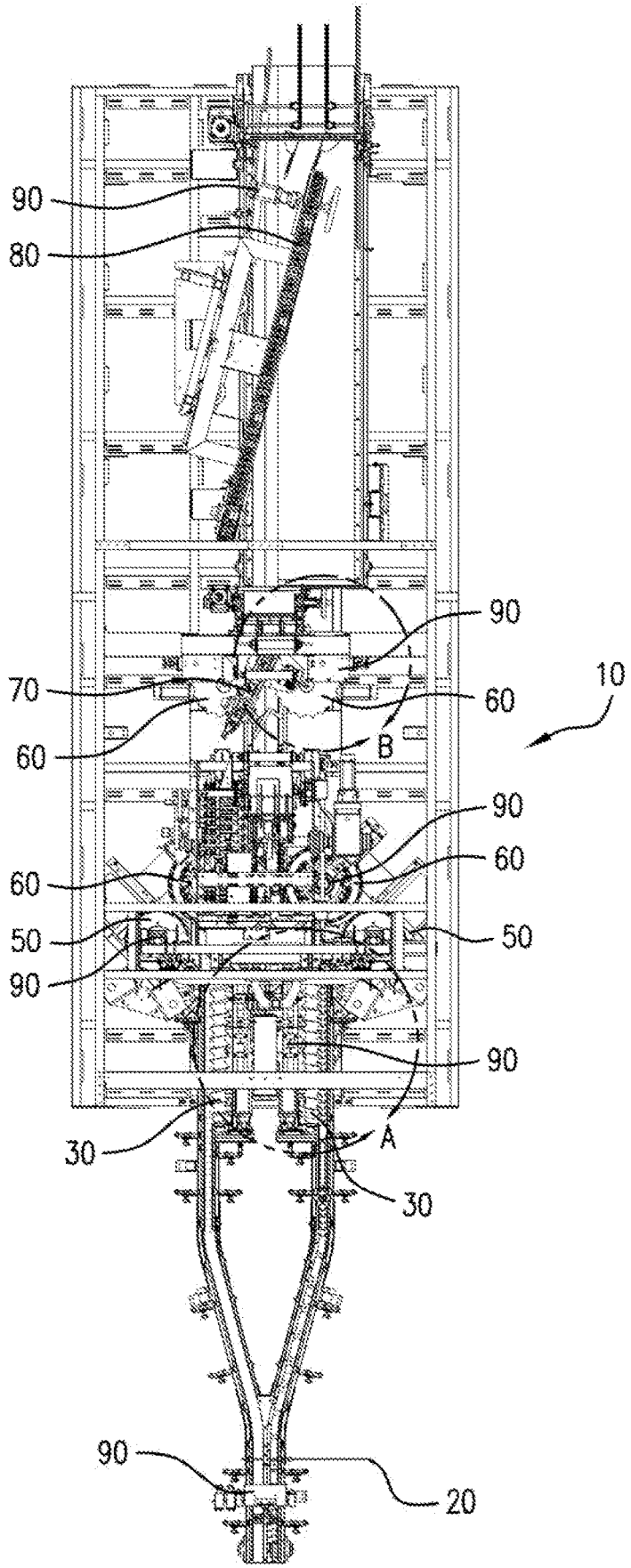
FIG. 1 is a top view of a packaging machine according to one preferred embodiment of this invention.
Figure 2:
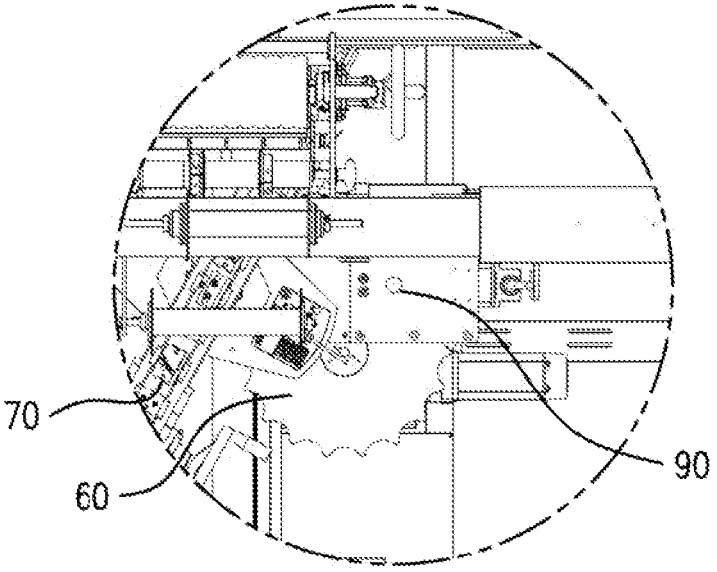
FIG. 2 is a detailed top view of the packaging machine shown in FIG. 1.
Figure 3:
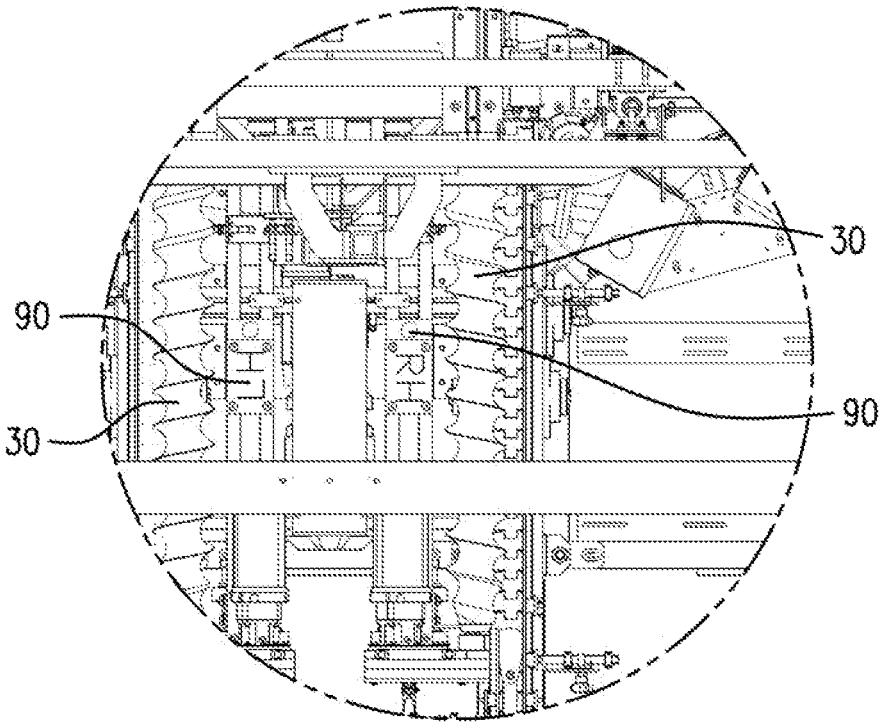
FIG. 3 is a detail top view of the packaging machine shown in FIG. 1.

FIGS. 1-3 show a packaging machine for unitizing containers in a container carrier. Container carriers may be, though not necessarily, formed from an elastic thermoplastic material having a plurality of container receiving openings, each for engaging a container. Alternatively, other packaging, known to those having ordinary skill in the art, such as paperboard, shrinkwrap, cartoning, gluing and/or other unitization and/or joining methods may be used in connection with the system.

In one example of a packaging machine 10 according to the present invention, as shown in FIGS. 1-3, an inlet conveyor 20 and infeed screw 30 feed the plurality of containers into the packaging machine 10 having an orienter 50, a starwheel 60 and a jaw drum 40. The jaw drum 40 preferably stretches the container carrier and thereupon engages each container with a respective container receiving opening. When the container carrier is stripped off the jaw drum 40, the container carrier elastically retracts around each container and tightly engages the plurality of containers. The jaw drum 40 typically rotates about a horizontal axis while the starwheel typically rotates about a vertical axis.

Container carriers preferably moves through the packaging machine from a reel stand where carriers are dispersed in a continuous string of carrier stock from either reels or large boxes of carrier stock and ultimately to packages where each carrier is separated into a unitized package, each package containing a plurality of uniform containers. A typical configuration for a package is a "six-pack" containing two longitudinal rows of containers in three transverse ranks. Additional desired packages such as four-packs, eight packs and twelve packs may be unitized using machine according to this invention, and such additional sizes of packages are limited only by the consumer market for such additional sizes.

The container carrier (and carrier stock) is preferably constructed from a flexible plastic sheet, such as low-density polyethylene or a blend containing similar desirable properties. The flexible plastic sheet is punched or otherwise formed into a plurality of container receiving apertures aligned in transverse ranks and at least two longitudinal rows to form a continuous sheet of carriers.

Accordingly, a plurality of containers is provided from the inlet conveyor and ultimately to the jaw drum for application of the container carriers to containers. As described, the jaw drum may be positioned with respect to the inlet conveyor to accept the plurality of containers. The carrier proceeds from a reel stand, carton and/or infeed to the jaw drum, particularly to a plurality of jaw pairs located radially about the jaw drum. The jaw drum preferably comprises a cylindrical member rotatable about a horizontal axis which transports the carrier to the plurality of containers which flow through the jaw drum. As the jaw pairs move with the rotation of jaw drum, container receiving apertures within the carrier stretch to accommodate a container. The carrier in a stretched condition is positioned over a plurality of containers so that each container receiving aperture engages with one container. Upon engagement with the containers, the carrier is released from the respective jaw pair and grips a perimeter of container.

An output conveyor preferably conveys the containers longitudinally from the jaw drum after the carrier has been applied. After the carrier is stripped from the jaw drum, a continuous string of unitized containers proceeds along the output conveyor and through a cutoff device. According to a preferred embodiment of this invention, the cutoff device is adjustable and/or replaceable with minimal use of tools to divide packages into any number of desired sizes.

As described above and shown in FIG. 1, a container carrier applicating machine 10 for packaging containers includes an inlet conveyor 20 transporting a plurality of containers. An infeed screw 30 unitizes each container from the inlet conveyor 20. As shown in FIGS. 1 and 2 and described herein, the applicating machine 10 preferably includes two infeed screws 30, one for each column of containers entering along the inlet conveyor 20 for ultimate presentation to the jaw drum 40.

An orienter 50 is provided between the inlet conveyor 20 and the jaw drum 40, the orienter 50 rotating each container into a desired rotational position. As shown in FIG. 1 and described herein, the applicating machine 10 may include two orienters 50, one in each lane of containers. In this way containers can be oriented within a package to all face in a desired direction. A starwheel 60 may then present the containers in an oriented position to the jaw drum 40.

The jaw drum 40 preferably includes a plurality of circumferentially positioned jaws that accommodate a generally continuous supply of container carriers and stretch the continuous supply of container carriers apart as the jaw drum 40 rotates for presentment to each container of the plurality of containers.

A cutoff device 70 is provided downstream of the jaw drum 40 to divide the container carriers into desired package sizes, for instance using a plurality of spaced knives that are conveyed around an overhead beam. An additional starwheel 60 may be positioned here to present the engaged containers in an orderly manner to the cutoff device 70.

As further shown in FIG. 1, a turner-diverter 80 is additionally provided downstream of the cutoff device 70 to direct packages off the applicating machine 10 for further processing, packaging and/or palletization.

A dedicated indicator 90 is preferably provided at each of the infeed screw 30 and the cutoff device 70 to provide an indication of whether the applicating machine 10 is synchronized. In this way, the applicating machine 10 may provide visual and/or audible signals to an operator that the intake of containers (at the infeed screw 30) and the outtake of packaged containers (at the cutoff device 70) is synchronized with a baseline axis or virtual axis of the applicating machine 10.

In addition, at least one of the orienter 50 and the turner-diverter 80 may also include additional dedicated indicators 90. The system according to one preferred embodiment of this invention preferably cooperates with at least the inlet conveyor 20, the infeed screw 30, the jaw drum 40, and the cutoff device 70.

In a standard system containing synchronized servo motion, each of the axes of each operative part of the applicating machine 10 (as described above) need to maintain a specific following relationship to ensure proper machine function. As such, a typical operating program will include methodology to maintain and recover this synchronization based on several motor position or velocity parameters. If one of these monitored parameters exceeds the following tolerance band the axes will require resynchronization. Typically, this can be performed as an automatic process once the system is cleared of product. The process of clearing the system, enabling the synchronization routine, and repriming the product can accumulate significant downtime and lead to lost production. Manual resynchronization methods can reduce this downtime, but this is largely a guess and test method of resolution. By introducing point of use feedback devices, or indicators 90, the recovery time can be significantly reduced maximizing machine uptime and productivity. For example, it is desirable for the invention to resolve axis synchronization faults in less than 5 minutes as opposed to 30+ minutes under the traditional methodology.

The subject system adds methods of direct user feedback to quickly and efficiently allow machine operators to resolve machine synchronization faults and return the machine to a running state. By deploying visual and/or auditory feedback at each point of use any operator regardless of skill level would be able to bring the machine back into synchronization and resume running. In one preferred embodiment described, a plurality of tri-color LED indicators 90 are added to each point of use feedback device. Therefore, an LED will glow red when the axis is out of synchronization, will glow yellow as the target is approached, and will glow green when it has been rotated into a recoverable position. The addition of chirping alarms to indicate the same states may additionally be used in place or in addition to the LED lights. In practice, an operator would notice, for example, the infect screw 30 glowing yellow and through manual adjustment forward or backward, place the in feed screw 30 back into synchronization and thus a green hue.

In this manner, an operator may bring a machine back into synchronization quickly and responsively without the downtime associated with stopping and clearing the machine or the damage to product associated with dramatic automatic resynchronization schemes. Further, an operator may simultaneously supervise several machines and understand when the machines are operating properly based on a green or other desirable hue below, atop and/or along each operative component.

A method of synchronization of container carrier applicating machine according to a preferred embodiment of this invention thus comprises connecting a plurality of point of use feedback devices or indicators 90 to operative components of the applicating machine 10 and providing visual feedback from a plurality of visual indicators 90 of a location of synchronized and/or unsynchronized components.

As shown in the figures, the plurality of point of use feedback devices may comprise two or more LED indicator 90. The LED indicators 90 may each provide two or more colored lights to indicate a condition of a machine axis. Desirably, the LED indicators 90 emit a green, yellow, and red light depending on a degree of synchronization of the machine. In one preferred embodiment of this invention, the LED indicators 90 are placed in unobtrusive and/or not readily visible locations on and/or within the machine 10 so that only a light is visible while in operation.

Each point of use feedback device is preferably connected with respect to an axis of rotation of components of the container carrier applicating machine 10. Within these components a baseline axis of rotation may be selected such as the jaw drum 40 or the orienter 50 for assessing synchronization.

Each of the plurality of point of use feedback devices are preferably located in physical proximity to each respective connected component. The plurality of point of use feedback devices may not be structurally visible. However, light emitted from the LED indicators 90 is preferably visible and thereby bathes the respective component in light such as one of green, yellow and red to indicate synchronization, partial synchronization or no synchronization, respectively.

While in the foregoing specification this invention has been described in relation to certain preferred embodiments thereof, and many details have been set forth for purpose of illustration, it will be apparent to those skilled in the art that the system and method according to this invention are susceptible to additional embodiments and that certain of the details described herein can be varied considerably without departing from the basic principles of the invention.

The invention claimed is:

1. A method of synchronization of container carrier applicating machine comprising:

connecting a plurality of point of use feedback devices to operative components of the applicating machine, wherein each point of use feedback device is connected with respect to an axis of rotation of the container carrier applicating machine;

selecting a baseline axis of rotation for assessing synchronization; and providing visual feedback from the plurality of feedback devices of a location of synchronized and/or unsynchronized components.

2. The method of claim 1 wherein the plurality of point of use feedback devices comprise two or more LED indicators.

3. The method of claim 2 wherein the two or more LED indicators each provide two or more colored lights to indicate a condition of a machine axis.

4. The method of claim 3 wherein the two or more LED indicator emit a green, yellow, and red light depending on a degree of synchronization of the machine.

5. The method of claim 1 further comprising providing an audible feedback of the synchronized and/or unsynchronized components.

6. The method of claim 1 wherein the plurality of point of use feedback devices are located in physical proximity to each respective connected component.

7. The method of claim 1 wherein the plurality of point of use feedback devices are not structurally visible.

8. A container carrier applicating machine for packaging containers comprising:

an inlet conveyor transporting a plurality of containers;

an infeed screw unitizing each container from the inlet conveyor;

a jaw drum having a generally continuous supply of container carriers for presentment to each container of the plurality of containers;

a cutoff device provided downstream of the jaw drum to divide the container carriers into desired package sizes; and a dedicated indicator provided at each of the infeed screw and the cutoff device to provide an indication of whether the applicating machine is synchronized, wherein the infeed screw is configured to adjust manually to move the dedicated indicator from out of synchronization to synchronized.

9. The container carrier applicating machine of claim 8 further comprising:

an orienter provided between the inlet conveyor and the jaw drum, the orienter rotating each container into a desired rotational position; and a turner-diverter provided downstream of the cutoff device to direct packages off the machine;

wherein at least one of the orienter and the turner-diverter includes additional dedicated indicators.

10. The container carrier applicating machine of claim 8 wherein the dedicated indicator comprises a light that signals one of green, yellow and red to indicate synchronization, partial synchronization or no synchronization, respectively.

11. The container carrier applicating machine of claim 8 wherein the dedicated indicator comprises an audio signal to indicate synchronization.

* * * * *